United States Patent [19]

Iiyama et al.

[11] Patent Number: 4,638,340

[45] Date of Patent: Jan. 20, 1987

[54] TWO-COLOR THERMOSENSITIVE RECORDING LABEL

[75] Inventors: Kiyotaka Iiyama, Mishima; Norihiko Inaba, Numazu, both of Japan

[73] Assignee: Ricoh Company, Ltd., Tokyo, Japan

[21] Appl. No.: 759,736

[22] Filed: Jul. 29, 1985

[30] Foreign Application Priority Data

Jul. 27, 1984 [JP] Japan ..... 59-158054

[51] Int. Cl.[4] ..... B41M 5/18

[52] U.S. Cl. ..... 346/204; 346/205; 346/206; 427/152; 428/40; 428/341; 428/342

[58] Field of Search ..... 346/200, 204, 205, 206, 346/226, 216, 217, 220, 221; 427/150, 151, 152; 428/40, 341, 342, 913, 914

[56] References Cited

U.S. PATENT DOCUMENTS 3,916,068 10/1975 Kohmura et al. ..... 346/205

FOREIGN PATENT DOCUMENTS 0054597 3/1984 Japan ..... 346/204
0105587 6/1985 Japan ..... 346/204
0105588 6/1985 Japan ..... 346/204

*Primary Examiner*—Bruce H. Hess

*Attorney, Agent, or Firm*—Oblon, Fisher, Spivak, McClelland, & Maier

[57] ABSTRACT

A two-color thermosensitive recording label capable of forming two different colors when heated at different temperatures is disclosed, which comprises: (a) a support material and the following layers successively formed thereon, (b) a first thermosensitive coloring layer which is colored in a first color at a predetermined high temperature T, formed on one side of the support material, (c) a decolorizing layer containing a decolorizing agent, (d) an intermediate layer, (e) a second thermosensitive coloring layer, which is colored in a second color at a predetermined low temperature, the second color being decolorized by the decolorizing agent when heated to a predetermined temperature, so that the color developed in the second thermosensitive coloring layer is prevented from being mixed with the color developed in the first thermosensitive coloring layer, and the second thermosensitive coloring layer and the second color are protected from the decolorizing layer by the intermediate layer so long as the second thermosensitive coloring layer is not heated up to the predetermined temperature, (f) a protective layer for protecting the second thermosensitive coloring layer, (g) an adhesive layer formed on the other side of the support, and (h) a disposable backing sheet which is attached to the adhesive layer.

13 Claims, No Drawings

TWO-COLOR THERMOSENSITIVE RECORDING LABEL

BACKGROUND OF THE INVENTION

The present invention relates to a two-color thermosensitive recording label capable of forming two different colors when heated at different temperatures, which comprises: (a) a support material and the following layers successively formed thereon, (b) a first thermosensitive coloring layer which is colored in a first color at a predetermined high temperature T, formed on one side of the support material, (c) a decolorizing layer containing a decolorizing agent, (d) an intermediate layer formed on the decolorizing layer, (e) a second thermosensitive coloring layer, which is colored in a second color at a predetermined low temperature, the second color being decolorized by the decolorizing agent when heated to a predetermined temperature, so that the color developed in the second thermosensitive coloring layer is prevented from being mixed with the color developed in the first thermosensitive coloring layer, and the second thermosensitive coloring layer and the second color are protected from the decolorizing layer by the intermediate layer so long as the second thermosensitive coloring layer is not heated up to the predetermined temperature, (f) a protective layer for protecting the second thermosensitive coloring layer, (g) an adhesive layer formed on the other side of the support, and (h) a disposable backing sheet which is attached to the adhesive layer and can be peeled off the adhesive layer when the thermosensitive recording label is used.

If necessary, another intermediate layer can be formed between the first thermosensitive coloring layer and the decolorizing layer.

A conventional thermosensitive recording material comprises a support material and a thermosensitive coloring layer formed on the support material. Colored images are formed on the thermosensitive coloring layer by application of heat thereto. For application of heat for such image formation, a thermal printer provided with a thermal head, a thermal pen and infrared rays are in general use. In such a conventional thermosensitive recording material, there are usually employed in the thermosensitive coloring layer (i) a colorless or light-colored leuco dye containing a lactone ring, a lactam ring or a spiropyran ring, and (ii) a color developer which induces color in the leuco dye upon application of heat by the reaction with the leuco dye, since it is capable of yielding clear images with reduced fogging.

Because of the capability of forming colored images by simple application of heat, such thermosensitive recording materials are used widely, not only for copying books and documents, but also for recording output information from computers, facsimile apparatus, telex and other information transmission and measuring instruments. Depending upon the recording mode, it will be more convenient if it is allowed to record particular data in a different color from the remainder on a thermosensitive recording material, in order to show the particular data more distinctly from the remainder.

Recently, many trials have been made to attain recording with multiple colors by application of heat at different temperatures or by application of different quantities of thermal energy. Accordingly, a variety of multi-color thermosensitive recording materials have been proposed.

A conventional multi-color thermosensitive recording sheet comprises a support material and two thermosensitive color-forming layers formed on the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms color at a low temperature, while the high-temperature color-forming layer does not form color at all at the low temperature, but forms color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color already developed in a low-temperature color-forming layer, so that a color different from the color in the low-temperature layer is produced in the high-temperature color-forming layer.

In the other type, when the high-temperature color-forming layer is colored, the color in the low-temperature color-forming layer is decolorized by a decolorizing agent, so that only the high-temperature color-forming layer is colored without the color of the low-temperature color-forming layer being mixed therewith.

Specific examples of the former type are disclosed, for instance, in Japanese Patent Publications No. 49-69, No. 49-4342 and No. 49-27708, and Japanese Laid-Open Patent Applications No. 48-86543 and No. 49-65239.

Specific examples of the latter type are disclosed, for instance, in Japanese Patent Publications No. 50-17865, No. 50-17866, No. 51-29024 and No. 51-87542, and Japanese Laid-Open Patent Applications No. 50-18048 and No. 53-47843.

The former type has the shortcoming that the practically developable color systems are limited to such combinations that the colors developed at high temperature can overcome the color developed at low temperature, such as yellow or red (low temperature)—black or blackish (high temperature).

In the latter type, there are no particular limitations to the combination of the colors to be developed. However, in this type, it is necessary to decolorize the color developed in the low-temperature color-forming layer when developing a color in the high-temperature color-forming layer. Conventionally, when a two-color thermosensitive recording material is designed in such a manner that the color developed in the low-temperature color-forming layer is completely decolorized by use of a decolorizing agent when developing a color in the high-temperature, the color developed in the low-temperature color-forming layer is also decolorized more or less by the decolorizing agent when developing the color in the low-temperature color-forming layer. On the other hand, when a two-color thermosensitive recording material is designed in such a manner as to obtain colored images with high density in the low-temperature color-forming layer, the color developed in the low-temperature color-forming layer cannot be completely decolorized when developing a color in the high-temperature color-forming layer. The result is that the separation of the color in the high temperature color-forming layer from the color in the low temperature color-forming layer is insufficient for practical use. In particular, a two-color thermosensitive recording material capable of yielding the combination of black or blackish (low temperature)—red (high temperature) has not been proposed, although this combination is most practical for office use and general use, since it is desirable to produce most frequently used black at low temperature.

Thermosensitive recording labels are widely employed as bar-coded labels. Recently they are used, for instance, in the fields of food industry, postal transportation, and automatic transportation systems in warehouses. Thermosensitive type bar codes have the advantages over conventional preprinted bar codes that any bar codes can be chosen as desired on the spot and can be simultaneously controlled by a computer system. In such bar-coded labels, if a particular portion is printed in a color different from the color of the remainder of the bar codes in order to attract attention to the particular portion, for instance, to show it as a corrected portion, or such a particular portion is automatically read for a particular purpose, the application range of the bar-coded labels will be significantly expanded. However, such thermosensitive recording labels have not been used.

SUMMARY OF THE INVENTION

It is therefore an object of the present invention to provide a two-color thermosensitive recording label capable of forming two different colors when heated at different temperatures, with distinct and high color separation.

According to the present invention, the above object of the present invention is achieved by a two-color thermosensitive recording label comprising:

(a) a support material, (b) a first thermosensitive coloring layer which is colored in a first color at a predetermined high temperature T, formed on one side of the support material, comprising a coloring agent and a first color developer capable of inducing color formation in the coloring agent when heated to the temperature T, (c) a decolorizing layer containing a decolorizing agent, formed on the first thermosensitive coloring layer, (d) an intermediate layer formed on the decolorizing layer, (e) a second thermosensitive coloring layer comprising a leuco dye and a second color developer capable of inducing color formation in the leuco dye when heated, formed on the intermediate layer, which coloring layer is colored in a second color at a predetermined low temperature t, the second color developed at the low temperature t being different from the first color, decolorized by the decolorizing agent when heated to a predetermined temperature which is higher than the temperature t, thereby preventing the color developed in the second thermosensitive coloring layer from being mixed with the color developed in the first thermosensitive coloring layer and the second thermosensitive coloring layer and the second color being protected from the decolorizing layer by the intermediate layer so long as the second thermosensitive coloring layer is not heated up to the predetermined temperature, (f) a protective layer for protecting the second thermosensitive coloring layer, formed on the second thermosensitive coloring layer, (g) an adhesive layer formed on the other side of the support, and (h) a disposable backing sheet which is attached to the adhesive layer and can be peeled off the adhesive layer when the thermosensitive recording label is used.

If necessary, a second intermediate layer can be formed between the first thermosensitive coloring layer and the decolorizing layer.

The first thermosensitive coloring layer (hereinafter referred to as the high-temperature coloring layer) formed on the support material can contain, in addition to a coloring agent and a color developer, a thermofusible material, an unguent, a binder agent, a pigment, a filler and an image stabilizing agent. Examples of the combination of the coloring agent and the color developer are (i) a leuco dye and a color developer capable of inducing color formation in the leuco dye when heated, (ii) a diazonium compound and a coupler, (iii) a ligand compound and a metal salt, (iv) a tetrazonium chloride, a reducing agent for the tetrazonium chloride, and if necessary, with addition of a metal salt thereto.

The intermediate layer, which is formed on the decolorizing layer, functions so as to avoid adverse effects of the decolorizing agent on the low-temperature coloring layer during storage of the thermosensitive recording label and during image formation on the label. The intermediate layer can contain a thermofusible material, a pigment working as filler, a water-soluble resin or latex in combination. Another intermediate layer which can be formed on the high-temperature layer can also comprises the same components as in the first intermediate layer.

The decolorizing layer consists essentially of a decolorizing agent. It can also contain a thermofusible material, a resin, a pigment working as filler.

Examples of the decolorizing agent are organic amines, hydrochloric acid salts of organic amines, amide, guanidine, glycol derivatives, and resins having amino groups.

The second thermosensitive coloring layer (hereinafter referred to as the low-temperature coloring layer), which is formed above the decolorizing layer through the intermediate layer, consists essentially of a leuco dye and a color developer. When necessary, a thermofusible material, a filler, a pigment and a water-soluble resin or latex can be contained in the second thermosensitive coloring layer as in the first thermosensitive coloring layer.

The protective layer formed on the low-temperature coloring layer serves to prevent components coming from the second thermosensitive coloring layer from adhering or sticking to a thermal head in the course of the printing process, thereby improving the head-matching properties of the thermosensitive recording label and the resistance to chemicals. The protective layer usually comprises a film-forming, heat-resistance resin, such as a water-soluble resin or latex.

In the present invention, leuco dyes are employed in the low-temperature coloring layer. Leuco dyes are also employed in the high-temperature coloring layer.

The leuco dyes for use in the present invention are those employed conventionally in the field of thermosensitive recording materials. They can be used alone or in combination.

Examples of such leuco dyes for use in the present invention are triphenylmethane-type leuco compounds, fluoran-type leuco compounds, phenothiazine-type leuco compounds, auramine-type leuco compounds and spiropyran-type leuco compounds.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7- -naphthylamino-4'-bromofluoran, and
3-diethylamino-6-methyl-7-mesidino-4',5'-benzofluoran.
3,6-dimethoxyfluoran,
3-(p-dimethylaminophenyl)-3-phenylphthalide,
3-di(1-ethyl-2-methylindole)-3-yl-phthalide,
3-diethylamino-6-phenyl-7-aza-fluoran,
3,3-bis(p-diethylaminophenyl)-6-dimethylaminophthalide,
2-bis(p-dimethylaminophenyl)methyl-5-dimethylaminobenzoic acid, and
3-(p-dimethylaminophenyl)-3-(p-dibenzylaminophenyl) phthalide.

As mentioned previously, these leuco dyes can be used alone or in combination.

As the color developer for use in the present invention, a variety of electron acceptors can be employed, for instance, phenolic materials, organic and inorganic acids, salts and esters of the acids, which react with the above leuco dyes when heat is applied thereto to induce color formation in the leuco dyes.

Specific examples of the above color developers are as follows: gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isoproylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-ispropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methlenebis(4-methyl-6-tert-butylphenol), 2,2'-dihydroxydiphneyl, ethyl p-hydroxybenzoate, propyl p-hydroxybenzoate, butyl p-hydroxybenzoate, benzyl p-hydroxybenzoate, chlorobenzyl p-hydroxybenzoate, o-chlorobenzyl p-hydroxybenzoate, p-methylbenzyl p-hydroxybenzoate, n-octyl p-hydroxybenzoate, zinc salicylate, 1-hydroxy-2-naphthoic acid, 2-hydroxy-6-naphthoic acid, zinc 2-hydroxy-6-naphthoate, 4-hydroxy diphenyl sulfone, 4-hydroxy-4'-chloro diphenyl sulfone, bis(4-hydroxyphenyl)sulfide, 2-hydroxy-p-toluic acid, zinc 3,5-di-tert-butylsalicylate, tin 3,5-di-tert-butylsalicylate, tartalic acid, oxalic acid, maleic acid, citric acid, succinic acid, stearic acid, 4-hydroxy phthalic acid, boric acid, zinc chloride and zinc aluminum.

Specific examples of binder agents for use in the low-temperature coloring layer, the high-temperature coloring layer and the decolorizing layer in the present invention are as follows: Polyvinyl alcohol; starch and starch derivatives; cellulose derivatives such as methoxycellulose, hydroxy-ethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

Further in the present invention, auxiliary additive components which are employed in the conventional thermosensitive recording materials, such as fillers, surface active agents and thermo-fusible materials (or unguents), can be employed.

As the fillers, for example, the following can be employed: Inorganic powder such as powder of calcium carbonate, silica, zinc oxide, titanium oxide, aluminum hydroxide, zinc hydroxide, barium sulfate, clay, talc and surface-treated calcium carbonate and silica; and organic powder such as powder of urea-formaldehyde resin, styrene/methacrylic acid copolymer and polystyrene resin.

As the thermo-fusible materials, for example, the following can be employed: higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermo-fusible organic compounds with a melting point ranging from about 60° C. to 300° C.

The above-mentioned fillers and thermofusible materials can be added to the layers other than the low-temperature and high-temperature layers.

The thermosensitive recording label according to the present invention can be prepared, for example, by applying a high-temperature thermosensitive coloring layer formation liquid containing the above-mentioned components to an appropriate support material such as paper, synthetic paper or plastic film, drying the applied thermosensitive coloring layer formation liquid and successively forming thereon the second intermediate layer (which can be omitted when unnecessary), the decolorizing layer, the first intermediate layer, the low-temperature coloring layer and the protective layer. Further, on the back side of the support material, an adhesive layer is formed by a conventional method so that the label can be fixed to a solid surface, such as a wrapping film and a wrapping paper, and a disposable backing sheet is attached thereto, which can be peeled off the adhesive layer when the thermosensitive recording label is used.

The thus prepared thermosensitive recording material according to the present invention can be employed for recording in a wide variety of fields.

It is preferable that the high-temperature coloring layer be deposited in an amount ranging from 2 g/m$^2$ to 10 g/m$^2$, the first and second intermediate layer each be in an amount ranging from 1 g/m$^2$ to 5 g/m$^2$, the decolorizing layer be in an amount ranging from 2 g/m$^2$ to 10 g/m$^2$, the low-temperature coloring layer be in an amount ranging from 2 g/m$^2$ to 10 g/m$^2$ and the protective layer be in an amount ranging from 0.5 g/m$^2$ to 7 g/m$^2$ on a dry basis.

By referring to the following examples, embodiments of a thermosensitive recording material according to the present invention will now be explained in detail.

EXAMPLE 1

Liquid A and Liquid B for preparing a low-temperature coloring layer formation liquid, Liquid C and Liquid D for preparing a high-temperature coloring layer formation liquid, Liquid E (decolorizing layer formation liquid), Liquid F (intermediate layer formation liquid) and Liquid G (protective layer formation liquid) were prepared by grinding the respective solid components in a sand mill until the volume mean particle size became ranged from 2 to 3 microns.

| | Parts by Weight |
|---|---|
| Liquid A | |
| 3-dibutylamino-7-(o-chloroanilino) fluoran | 20 |
| 10% aqueous solution of hydroxyethylcellulose | 20 |
| Water | 60 |
| Liquid B | |
| 3,3'-dichlorophenylthiourea | 10 |
| Calcium carbonate | 10 |
| 10% aqueous solution of polyvinyl alcohol | 20 |
| Water | 60 |
| Liquid C | |
| 3-diethylamino-7-chlorofluoran | 20 |
| 10% aqueous solution of hydroxyethylcellulose | 20 |
| Water | 60 |
| Liquid D | |
| Bisphenol A | 10 |
| 10% aqueous solution of hydroxyethylcellulose | 15 |
| Calcium carbonate | 10 |
| Water | 65 |
| Liquid E | |
| 4,4'-dithiomorpholine | 20 |
| 10% aqueous solution of polyvinyl alcohol | 20 |
| Water | 60 |
| Liquid F | |
| N,N'—dioctadecylisophthaloamide | 10 |
| 10% aqueous solution of polyvinyl alcohol | 100 |
| Liquid G | |
| Silica | 2.5 |
| 10% aqueous solution of polyvinyl alcohol | 60 |
| Zinc stearate | 1.5 |

5 parts by weight of Liquid C and 40 parts by weight of Liquid D were mixed so that a high-temperature coloring layer formation liquid was prepared.

The high-temperature coloring layer formation liquid was coated uniformally on a sheet of high quality paper (about 50 g/m$^2$) so as to form a high-temperature coloring layer with a deposition of 7.5 g/m$^2$ of solid components thereof when dried.

When the high-temperature coloring layer was completely dried, Liquid F serving as an intermediate layer formation liquid was coated on the high-temperature coloring layer, with a deposition of 2.0 g/m$^2$ of solid components thereof when dried, so that a second intermediate layer was formed on the high-temperature coloring layer.

Liquid E serving as a decolorizing layer formation liquid was then coated on the intermediate layer with a deposition of 4.5 g/m$^2$ when dried, so that a decolorizing layer was formed on the intermediate layer.

Liquid F was further coated on the decolorizing layer, with a deposition of 2.0 g/m$^2$ of solid components thereof when dried, so that a first intermediate layer was formed on the decolorizing layer.

5 parts by weight of Liquid A and 40 parts by weight of Liquid B were mixed so that a low-temperature coloring layer formation liquid was prepared.

The low-temperature coloring layer formation liquid was coated on the decolorizing layer, with a deposition of 4.0 g/m$^2$ when dried, so that a low-temperature coloring layer was formed on the decoloring layer.

Liquid G serving as a protective layer formation liquid was coated on the low-temperature coloring layer, with a deposition of 3.0 g/m$^2$ of solid components thereof when dried, so that a protective layer was formed on the low-temperature coloring layer.

A polyacrylic resin type adhesive was then coated on the back side of the high quality paper serving as the support. A disposable backing sheet made of high quality paper (about 50 g/m$^2$) with a coating of a non-sticking silicone resin was applied to the polyacrylic rein type adhesive layer, whereby a two-color thermosensitive recording label No. 1 according to the present invention was prepared.

Thermal bar-code printing was performed on the two-color thermosensitive recording label No. 1 by a thermal bar-code printing apparatus with application of a printing thermal energy of 0.8 mJ/dot. As a result, clear black bar codes were printed. Thermal bar-code printing was then performed at higher temperatures with application of printing thermal energies of 1.6 mJ/dot and 2.4 mJ/dot. As a result, clear red bar codes were printed. After several months, the thus printed black and red bar codes remained stable.

EXAMPLE 2

Example 1 was repeated except that the second intermediate layer formed between the high-temperature coloring layer and the decolorizing layer was eliminated, so that a two-color thermosensitive recording label No. 2 according to the present invention was prepared.

Thermal bar-code printing was performed in the same manner as in Example 1. As a result, clear black and red bar codes were printed in a stable manner, although the red bar codes were slightly lower in density as compared with the density obtained in Example 2.

EXAMPLE 3

Example 1 was repeated except that N,N'-dioctadecylisophthaloimide in Liquid F serving as the intermediate layer formation liquid was replaced by polyethylene wax (with a softening point of 128° C.), so that a two-color thermosensitive recording label No. 3 according to the present invention was prepared.

Thermal bar-code printing was performed in the same manner as in Example 1. As a result, clear black and red bar codes were printed in the same manner as in Example 1.

What is claimed is:

1. A two-color thermosensitive recording label capable of forming two different colors when heated at different temperatures comprising:

(a) a support material, (b) a first thermosensitive coloring layer which is colored in a first color at a predetermined high temperature T, formed on one side of said support material, comprising a coloring agent and a first color developer capable of inducing color formation in said coloring agent when heated to the temperature T, (c) a decolorizing layer containing a decolorizing agent, formed on said first thermosensitive coloring layer, (d) an intermediate layer formed on said decolorizing layer, (e) a second thermosensitive coloring layer comprising a leuco dye and a second color developer capable of inducing color formation in said leuco dye when heated, formed on said intermediate layer, which coloring layer is colored in a second color at a predetermined low temperature t which is lower than said temperature T, said second color developed at said low temperature t being different from said first color, decolorized by said decolorizing agent when heated to a predetermined temperature which is higher than the temperature t so as to prevent the color developed in said second thermosensitive coloring layer from being mixed with said color developed in said first thermosensitive coloring layer comprising a thermofusible material and said second thermosensitive coloring layer and said second color being protected from said decolorizing layer by said intermediate layer so long as said second thermosensitive coloring layer is not heated up to said predetermined temperature, (f) a protective layer for protecting said second thermosensitive coloring layer, formed on said second thermosensitive coloring layer, (g) an adhesive layer formed on the other side of said support, and (h) a disposable backing sheet which is attached to said adhesive layer and can be peeled off said adhesive layer when said thermosensitive recording label is used.

2. A two-color thermosensitive recording label as claimed in claim 1, further comprising a thermofusible intermediate layer between the first thermosensitive coloring layer and said decolorizing layer, said intermediate layer being for protecting said first thermosensitive coloring layer from said decolorizing layer.

3. A two-color thermosensitive recording label as claimed in claim 2, wherein said intermediate layer is deposited in an amount ranging from 1 g/m$^2$ to 5 g/m$^2$ on a dry basis.

4. A two-color thermosensitive recording label as claimed in claim 1, wherein said coloring agent contained in said first thermosensitive coloring layer is a leuco dye.

5. A two-color thermosensitive recording label as claimed in claim 1, wherein said leuco dye contained in said second thermosensitive coloring layer is selected from the group consisting of triphenylmethane-type leuco compounds, fluoran-type leuco compounds, phenothiazine-type leuco compounds, auramine-type leuco compounds and spiropyran-type leuco compounds.

6. A two-color thermosensitive recording label as claimed in claim 4, wherein said leuco dye contained in said first thermosensitive coloring layer is selected from the group consisting of triphenylmethane-type leuco compounds, fluoran-type leuco compounds, phenothiazine-type leuco compounds, auramine-type leuco compounds and spiropyran-type leuco compounds.

7. A two-color thermosensitive recording label as claimed in claim 1, wherein said leuco dye contained in said second thermosensitive coloring layer is selected from the group consisting of:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7- -naphthylamino-4'-bromofluoran,
3-diethylamino-6-methyl-7-mesidino-4',5'-benzofluoran,
3,6-dimethoxyfluoran,
3-(p-dimethylaminophenyl)-3-phenylphthalide,
3-di(1-ethyl-2-methylindole)-3-yl-phthalide,
3-diethylamino-6-phenyl-7-aza-fluoran,
3,3-bis(p-diethylaminophenyl)-6-dimethylaminophthalide,
2-bis(p-dimethylaminophenyl)methyl-5-dimethylaminobenzoic acid, and
3-(p-dimethylaminophenyl)-3-(p-dibenzylaminophenyl)phthalide.

8. A two-color thermosensitive recording label as claimed in claim 1, wherein said second color developer contained in said second thermosensitive coloring layer is selected from the group consisting of gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isoproylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-ispropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxy-benzoate, chlorobenzyl p-hydroxybenzoate, o-chlorobenzyl p-hydroxybenzoate, p-methylbenzyl p-hydroxybenzoate, n-octyl p-hydroxybenzoate, zinc salicylate, 1-hydroxy-2-naphthoic acid, 2-hydroxy-6-naphthoic acid, zinc 2-hydroxy-6-naphthoate, 4-hydroxy diphenyl sulfone, 4-hydroxy-4'-chloro diphenyl sulfone, bis(4-hydroxyphenyl)sulfide, 2-hydroxy-p-toluic acid, zinc 3,5-di-tert-butylsalicylate, tin 3,5-ditert-butylsalicylate, tartalic acid, oxalic acid, maleic acid, citric acid, succinic acid, stearic acid, 4-hydroxy phthalic acid, boric acid, zinc chloride and zinc aluminum.

9. A two-color thermosensitive recording label as claimed in claim 1, wherein said first thermosensitive coloring layer is deposited on said support material in an amount ranging from 2 g/m$^2$ to 10 g/m$^2$ on a dry basis.

10. A two-color thermosensitive recording label as claimed in claim 1, wherein said intermediate layer is deposited in an amount ranging from 1 g/m$^2$ to 5 g/m$^2$ on a dry basis.

11. A two-color thermosensitive recording label as claimed in claim 1, wherein said decolorizing layer is deposited in an amount ranging from 2 g/m$^2$ to 10 g/m$^2$ on a dry basis.

12. A two-color thermosensitive recording label as claimed in claim 1, wherein said second thermosensitive coloring layer is deposited on said support material in an amount ranging from 2 g/m$^2$ to 10 g/m$^2$ on a dry basis.

13. A two-color thermosensitive recording label as claimed in claim 1, wherein said protective layer is deposited on said second thermosensitive coloring layer in an amount ranging from 0.5 g/m$^2$ to 7 g/m$^2$ on a dry basis.

* * * * *